US005672933A

United States Patent [19]

Wilson et al.

[11] Patent Number: 5,672,933

[45] Date of Patent: Sep. 30, 1997

[54] COLUMN-TO-COLUMN ISOLATION IN FED DISPLAY

[75] Inventors: Arthur M. Wilson; Robert H. Taylor; Chi-Cheong Shen, all of Richardson, Tex.

[73] Assignee: Texas Instruments Incorporated, Dallas, Tex.

[21] Appl. No.: 550,050

[22] Filed: Oct. 30, 1995

[51] Int. Cl.[6] ..... H01J 1/30

[52] U.S. Cl. ..... 313/336; 313/309; 313/351

[58] Field of Search ..... 313/309, 336, 313/351, 495, 496, 497; 315/169.4, 169.1, 35

[56] References Cited

U.S. PATENT DOCUMENTS

| | | | |
|---|---|---|---|
| 3,755,704 | 8/1973 | Spindt et al. | 313/309 |
| 3,812,559 | 5/1974 | Spindt et al. | 29/25.18 |
| 4,857,161 | 8/1989 | Borel et al. | 204/192.26 |
| 4,940,916 | 7/1990 | Borel et al. | 313/306 |
| 5,194,780 | 3/1993 | Meyer | 315/35 |
| 5,225,820 | 7/1993 | Clerc | 340/752 |
| 5,536,993 | 7/1996 | Taylor et al. | 313/336 |
| 5,541,466 | 7/1996 | Taylor et al. | 313/336 |
| 5,569,975 | 10/1996 | Taylor et al. | 313/336 |

FOREIGN PATENT DOCUMENTS 2687839 8/1993 France .

*Primary Examiner*—Nimeshkumar Patel

*Attorney, Agent, or Firm*—Warren L. Franz; Wade James Brady, III; Richard L. Donaldson

[57] ABSTRACT

An electron emitter plate (10, 10') for an FED image display has a gate conductive layer (22) spaced by a dielectric insulating layer (25) from a cathode conductive layer formed into a mesh (18). Arrays (12) of microtips (14) are located within mesh spacings (16) for field emission of electrons toward a phosphor layer (34) of an anode plate (11). Cathode layer (18) is patterned into column stripes (19) separated by gaps (17). Gate layer (22) is patterned into row cross-stripes (24) separated by gaps (23) which intersect with stripes (19) at matrix addressable pixel locations (30). Resistive layer (15) is patterned into stripes (40) separated by gaps (42) which interrupt column-to-column electrical communication through resistive layer (15). Unetched strips (43) are provided to bridge gap discontinuities for deposition of gate layer (22) at crossovers of rows (24) between columns (19). In one embodiment, gate layer (22) has a mesh pattern with apertured pads (46) commonly connected along resistive gap edges by marginal buses (50) formed on borders (49) of resistive layer (15) along gaps (42). Adjacent marginal buses (50) are connected by crossover buses (52) formed over bridging strips (43).

23 Claims, 7 Drawing Sheets

COLUMN-TO-COLUMN ISOLATION IN FED DISPLAY

The present invention relates generally to electron emitting structures of the field emission type; and, in particular, to improved microtip emission cathode structures and FED field emission flat-panel image display devices utilizing such structures. The invention also relates to methods for making such structures and devices.

BACKGROUND OF THE INVENTION

Examples of conventional electron emitting devices of the type to which the present invention relates are disclosed in U.S. Pat. Nos. 3,755,704; 3,812,559; 4,857,161; 4,940,916; 5,194,780; 5,225,820 and in French Patent No. 2,687,839. The disclosures of those patents are incorporated herein by reference.

Microtip emission cathode structures usable in FED field emission flat-panel image display devices, as described in the referenced patents, typically comprise thin film metal/insulator/metal sandwich structures deposited on an insulating substrate. In a usual self-aligning method of fabrication, first and second conductive layers are deposited on the substrate, separated by an intervening dielectric insulating layer which functions to space and insulate the conductive layers. The bottom conductive layer functions as the emitting or cathode electrode. The top conductive layer functions as the extractor or gate electrode. Apertures are formed in the top conducting layer and in the intervening dielectric material, and a microtip emitter (variously referred to as an electron field emitting cone, point, spike, needle or protuberance) is formed within each aperture in electrical communication with the bottom conductive layer.

Early implementations formed the microtips directly on the lower or cathode electrode. Such arrangements, however, provided little or no protection against excessive current draw. To limit the current in each microtip and consequently homogenize the electron emission, a resistive layer was interposed between the bottom conductive layer and the microtips, as shown in the Borel et al. '916 patent. Thereafter, to protect against defects (viz. pinholes) in the vertical thickness of the resistive layer and to increase the resistive path without requiring a corresponding increase in resistive layer thickness, the cathode electrode was patterned into a mesh configuration and the microtips were positioned within mesh spacings, separated laterally from the mesh structure grid by the resistive layer. This arrangement is shown in the Meyer '780 patent. The mesh structure of the cathode conductor permits the cathode conductor and the resistive path to lie substantially in the same plane. As shown in the French '839 patent, to reduce capacitance of the metal/insulator/metal sandwich, the upper or gate electrode can also be patterned into a mesh configuration to minimize the metal-to-metal overlap between the top and bottom conductive layers. In such case, the gate and cathode mesh structures are offset so that connected pads at grid intersections of the gate mesh are located centrally within spacings of the cathode mesh. The microtips are formed in apertures defined in arrays on the central pads.

In order to provide for matrix addressing, the cathode electrode is further patterned into stripes (referred to as "columns") and the gate electrode is further patterned into cross-stripes (referred to as "rows") which preferably, but not of necessity, run perpendicular to the stripes. Intersections (viz. crossovers) of the column stripes and row cross-stripes define pixels. To render the pixels individually electrically addressable, portions of the conductive layers are removed to provide gaps between adjacent column stripes and between adjacent row cross-stripes. No corresponding electrical isolation patterning is, however, undertaken for the resistive layer; so, energization of one cathode conductive layer column effects like, albeit reduced, energization of adjacent columns through the unbroken resistive layer. This can degrade system performance, particularly in display implementations of such microtip emission structures. To pattern the resistive layer in stripes that match the cathode conductive layer stripes, on the other hand, risks the introduction of nonumiformities and discontinuities along the lengths of the cross-stripes at transitions from one column to another, especially where the gate conductive layer encounters sudden drops in the underlying terrain during the deposition process.

It is, therefore, an object of the present invention to provide column-to-column isolation in microtip emission cathode structures and displays of the types described; and, in particular, to do so while maintaining continuity of the gate metallization along the rows, at transitions from one column to another.

SUMMARY OF THE INVENTION

The invention provides improved electron emitting structures of the field emission type, and improved FED field emission flat-panel image display devices utilizing such structures. The invention also provides methods for making such structures and devices.

An electron emitter apparatus is provided having a metal/insulator/metal sandwich structure comprising layers of conductive material deposited on a substrate and separated by an intervening layer of dielectric insulating material. The first conductive layer is patterned in a mesh structure, providing mesh spacings. The second conductive layer has apertures arranged within the mesh spacings, and conductive microtips are formed within the apertures. A layer of resistive material laterally spaces the microtips from the surrounding mesh structure. The resistive layer is deposited either before or after the first conductive layer. The mesh of the first conductive layer is patterned into stripes, separated by gaps, to define individually addressable columns of a cathode electrode. The second conductive layer is patterned into cross-stripes, separated by gaps, to define individually addressable rows of a gate electrode. The electrodes are connected to a voltage source to apply a negative potential to a selected column stripe relative to a selected row cross-stripe, thereby inducing an electric field which draws electrons from the microtips associated with the zone of overlap of the intersection of the thus selected column and row stripes.

In one aspect of the invention, the resistive layer is patterned in stripes which are generally aligned with the column stripes of the first conductive layer. The resistive layer stripes are separated by gaps or voids which interrupt column-to-column electrical communication through the resistive layer over a major portion of the substrate between adjacent column stripes. Paths of resistive material are provided to bridge gap discontinuities at crossovers of the row cross-stripes between adjacent columns. In preferred embodiments, the resistive material is deposited in a uniform layer, either before or after deposition of the first conductive layer, and the gaps are etched from the uniform layer, leaving bridging portions remaining. The dielectric is then deposited uniformly over the resistive layer stripes and bridges, providing continuities in terrain thickness of the subsurface over which the second conductive layer is deposited.

In another aspect of the invention, the second layer of conductive material is patterned to provide voids in the second conductive layer overlying unbridged portions of the gaps between adjacent resistive layer stripes. Electrical continuity at row crossover transitions between adjacent resistive layer stripes is provided through bus connections defined by strips of second conductive layer material formed on the dielectric layer, over the resistive layer bridges.

In yet another aspect of the invention, the second conductive layer is given a mesh pattern offset from the first conductive layer mesh pattern, with apertured pads at grid intersections within first conductive layer mesh spacings. Pads of the same row associated with a particular column are commonly connected along resistive gap edges by buses defined by strips of second conductive layer material formed on the dielectric layer, over resistive layer material running marginally along the edges of the resistive layer gaps. Those marginal buses are then connected to similar marginal buses of adjacent columns, by crossover buses formed over the resistive layer bridges.

The invention improves electrical isolation between column stripes of metal/insulator/metal sandwich field emission electron emitters and displays, while preserving continuous and smooth transitions at column-to-column crossovers of transversely oriented row cross-stripes. Decoupling adjacent columns by eliminating much of the intervening resistive layer material improves general power consumption by lessening the metalization area that has to be driven when energizing any particular column. Such adjacent column decoupling, especially when combined with patterning of the gate electrode to reduce gate-to-cathode metallization overlap, also improves high switching rate $\frac{1}{2}CV^2$ power consumption by reducing gate-to-cathode capacitance.

BRIEF DESCRIPTION OF THE DRAWINGS

Embodiments of the invention have been chosen for purposes of illustration and description, and are shown with reference to the accompanying drawings, wherein.

Throughout the drawings, like elements are referred to by like numerals.

DETAILED DESCRIPTION OF PREFERRED EMBODIMENTS

The principles of the invention are illustrated with reference to an exemplary implementation of an FED (field emission device) flat-panel image display device shown in FIGS. 1–6.

Figure 1:
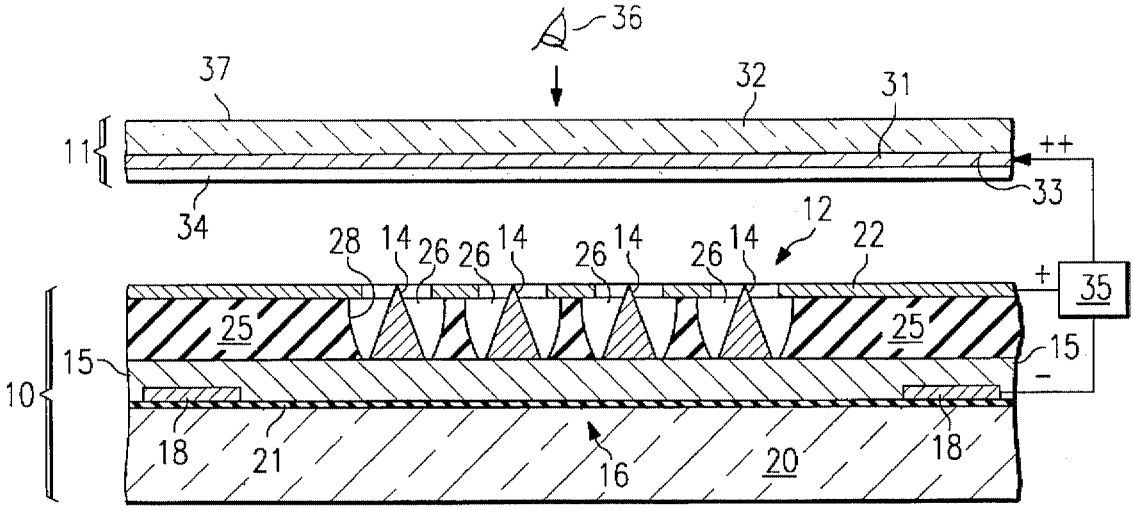
FIG. 1 is a section view, taken along the line 1—1 of FIG. 2, of a single mesh spacing subpixel portion of an FED display incorporating an electron emitting structure in accordance with the invention.
Figure 4:
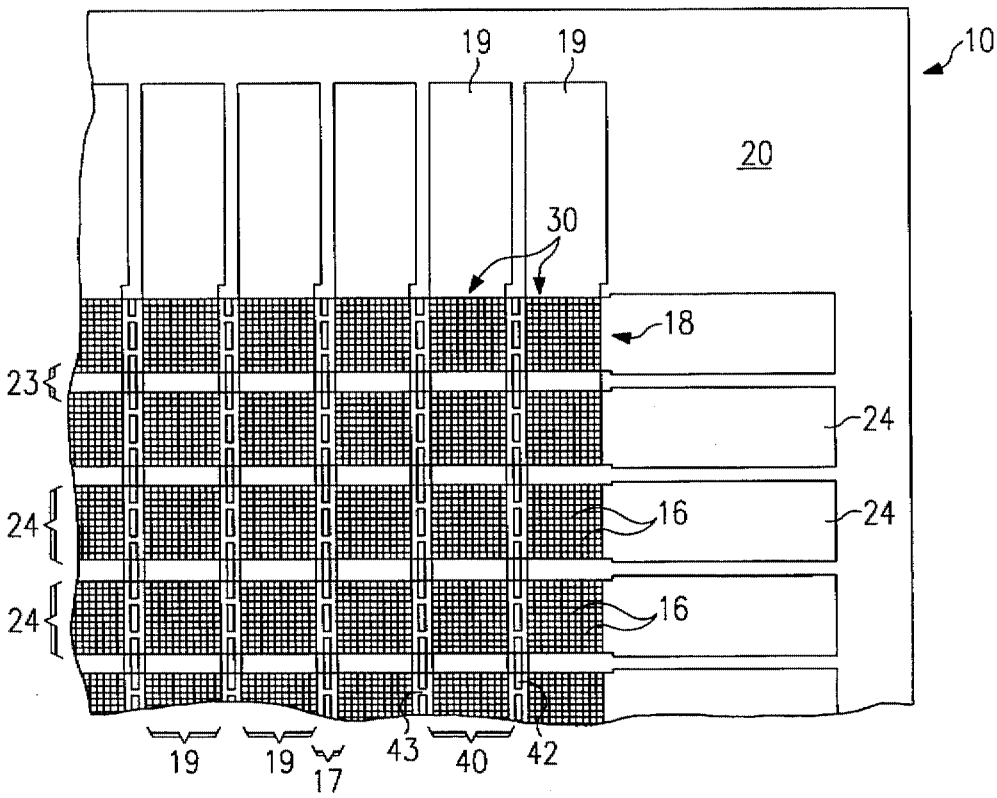
FIG. 4 is a schematic macroscopic top view of a corner of the cathode plate, useful in understanding the row-column, pixel-establishing intersecting relationships between the cathode grid and gate electrodes shown in greater enlargement in FIGS. 2 and 3.
Figure 2:
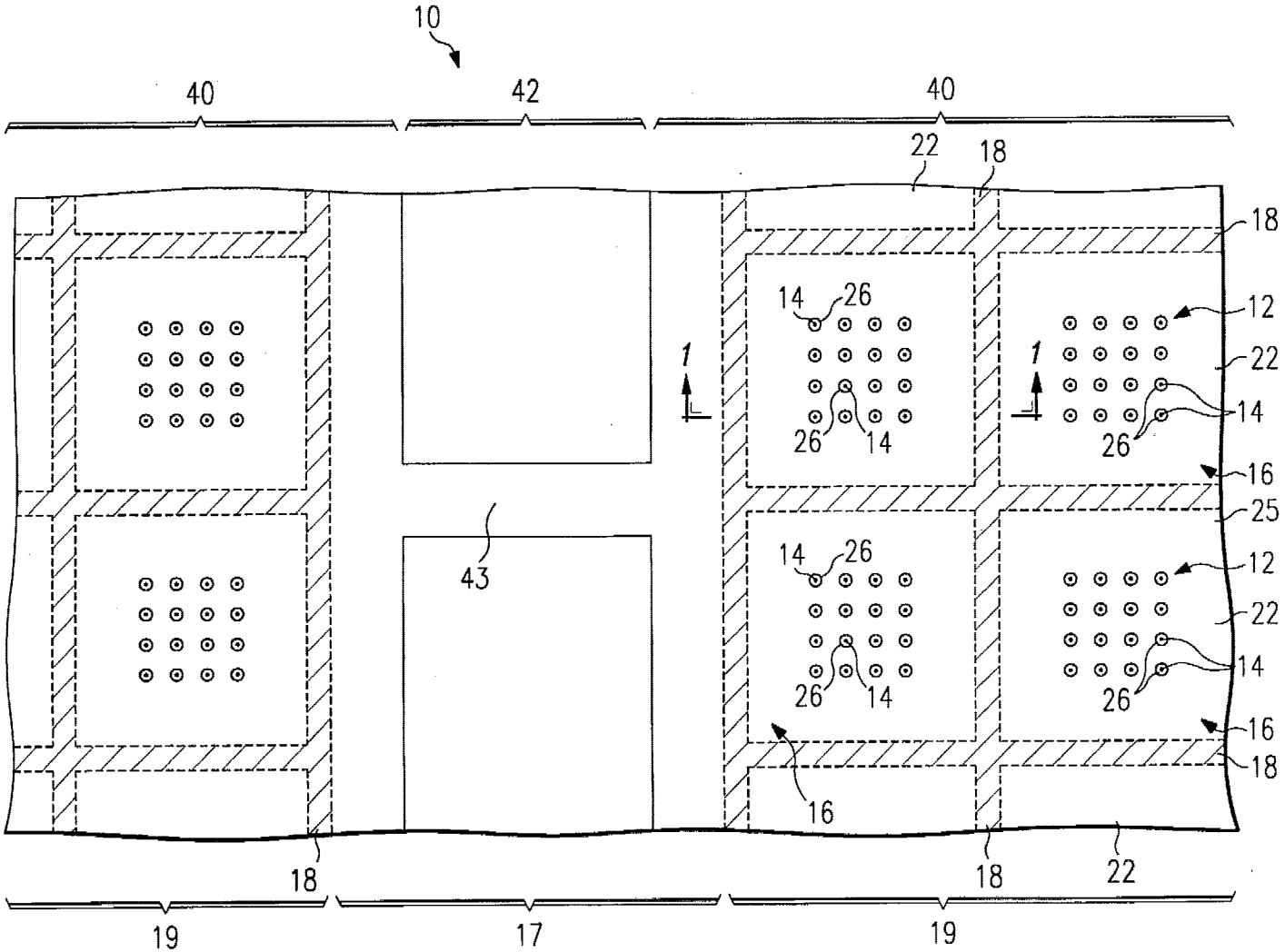
FIG. 2 is a top plan view of a multiple subpixel portion, showing a column-to-column transition, of the image forming area of the cathode plate of the display of FIG. 1.
Figure 3:
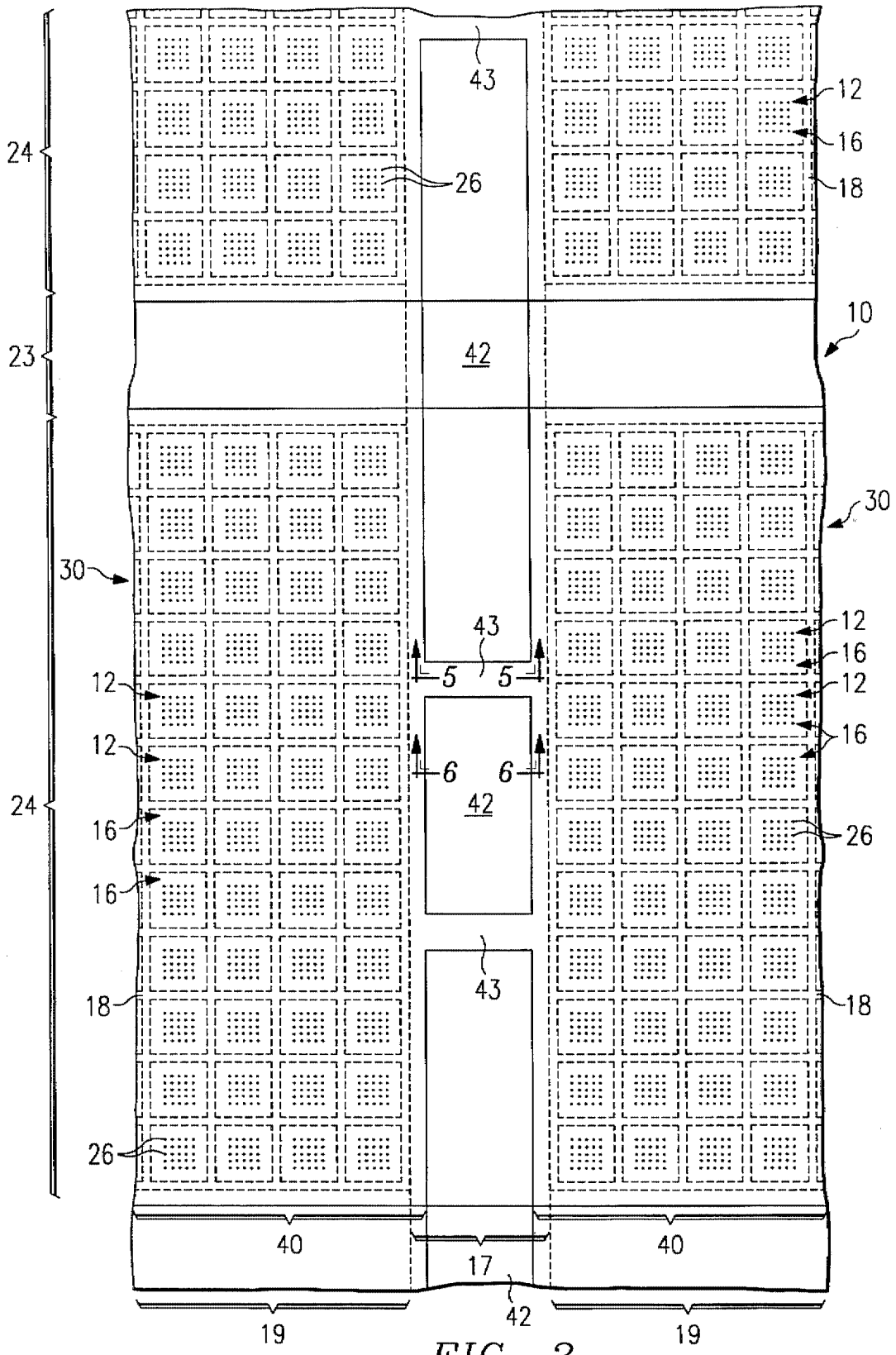
FIG. 3 is a view, as in FIG. 2, of a larger portion of the same image forming area.
Figure 5:
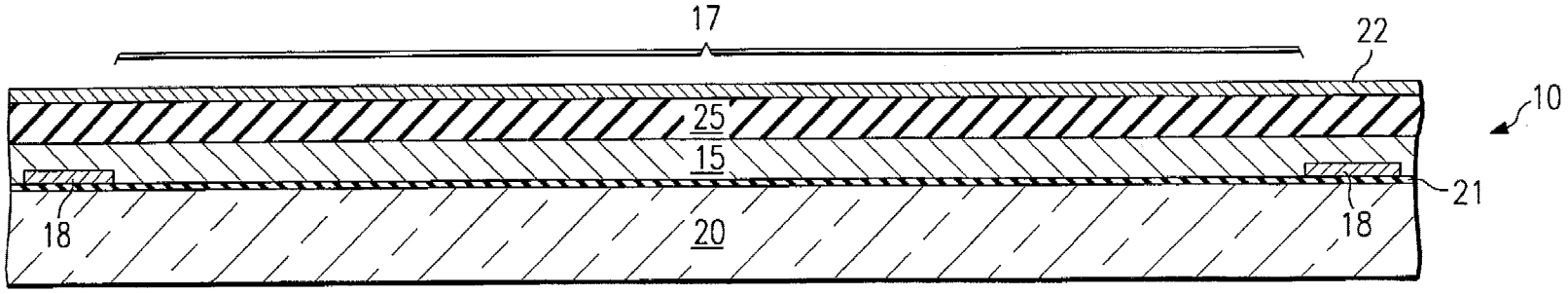
FIGS. 5 and 6 are section views, respectively taken along the lines 5—5 and 6—6 of FIG. 3.
Figure 6:
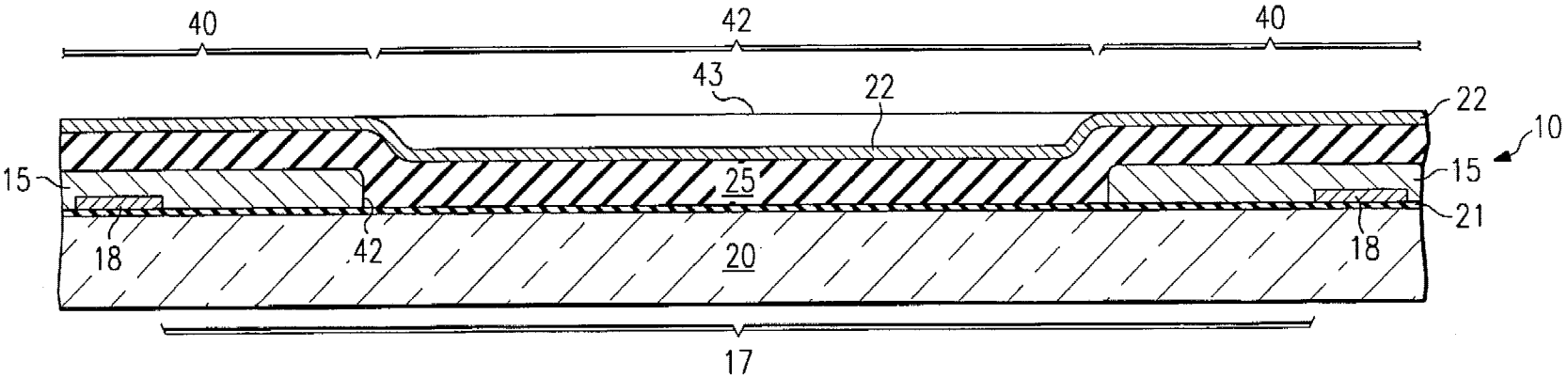
Figure 7:
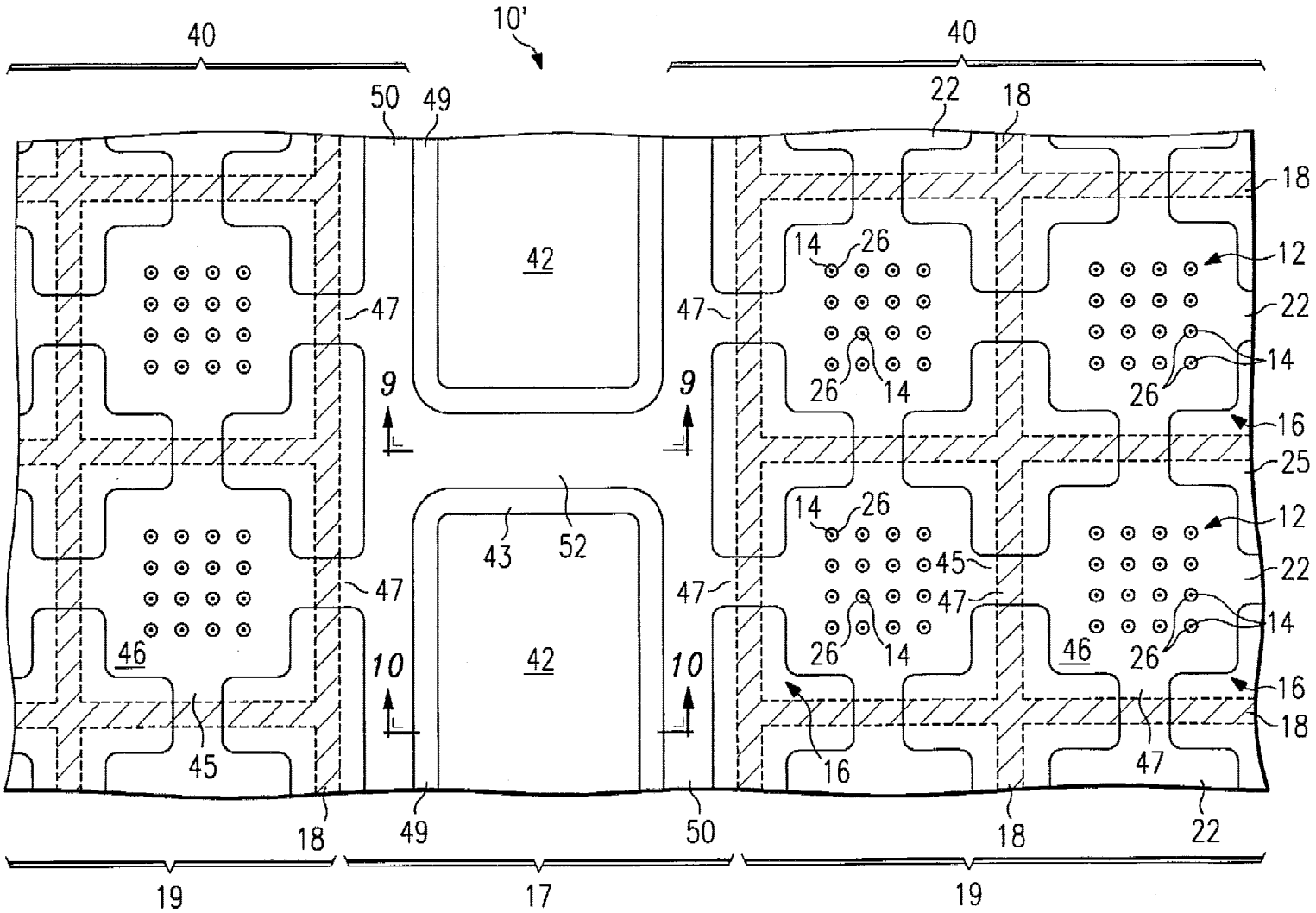
FIGS. 7–10 are views, respectively corresponding to those of FIGS. 2–6, of a modified form of the electron emitting structure.
Figure 8:
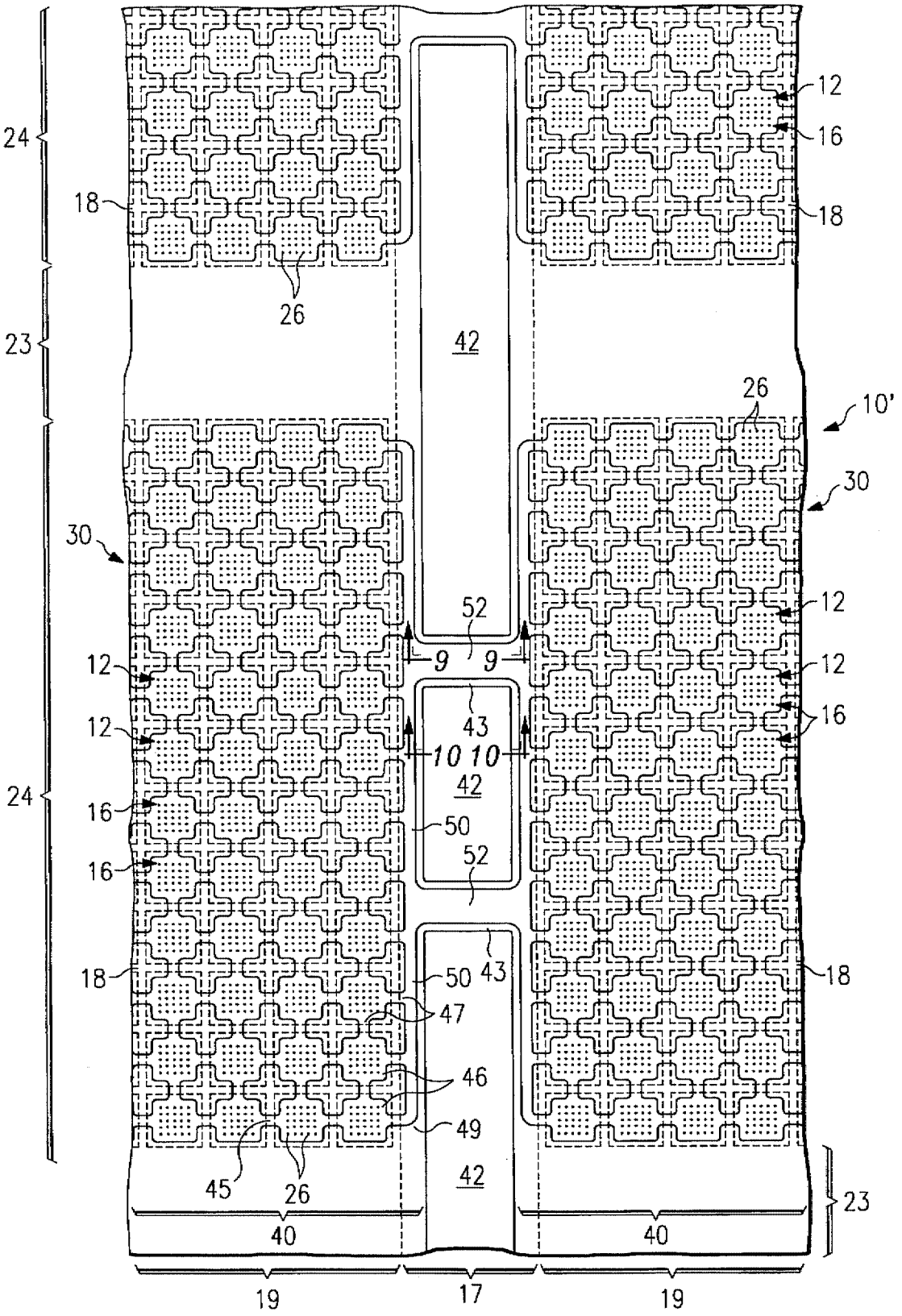
Figure 9:
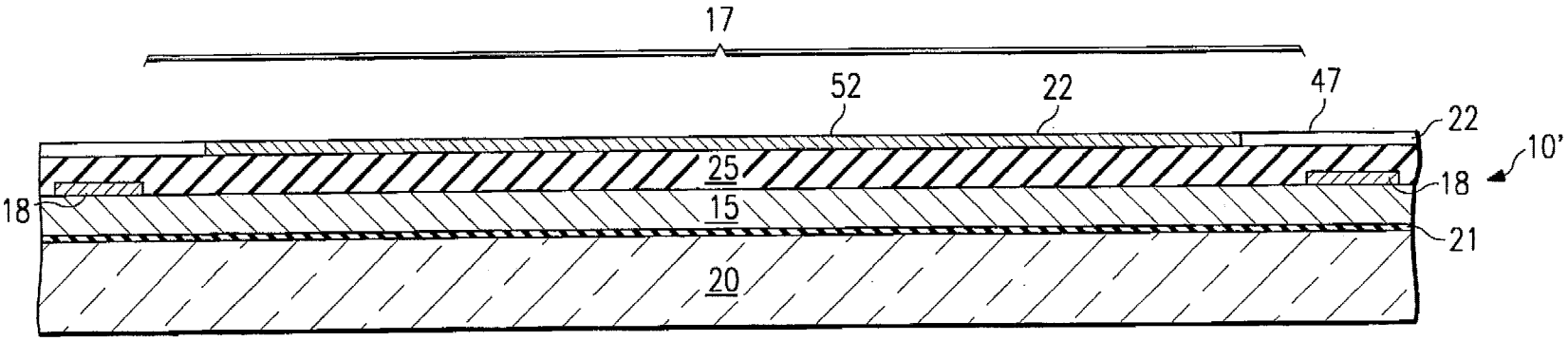
Figure 10:
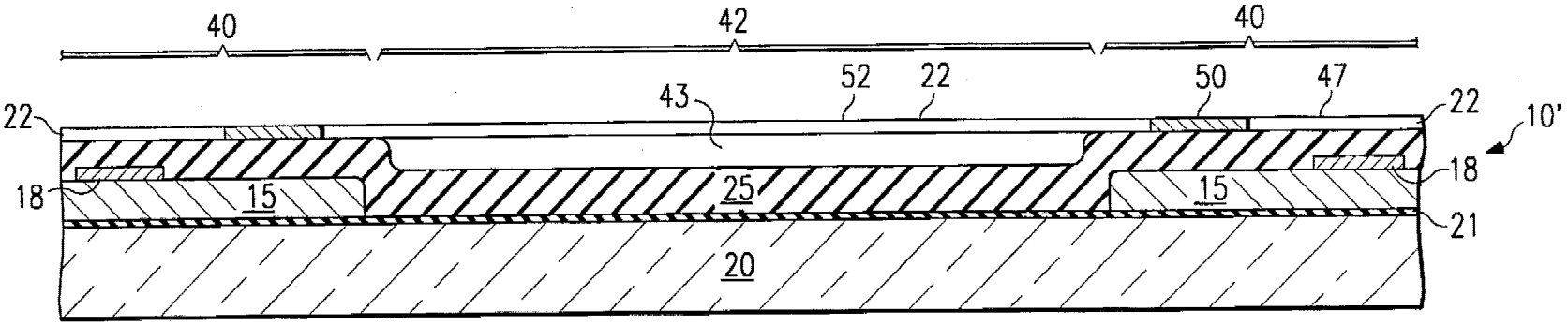

The display device has an electron emitter or cathode plate 10 spaced across a vacuum gap from an anode plate 11 (FIG. 1). Emitter plate 10 comprises a plurality of arrays 12 of electrically conductive microtips 14 formed on a resistive layer 15 within respective mesh spacings 16 of a cathode electrode grid mesh structure 18 (indicated by shading in FIG. 2). Mesh structure 18 is patterned in an image forming area of a layer of electrically conductive material deposited on an upper surface of an electrically insulating glass or silicon substrate 20 which is overlaid with a thin silicon dioxide ($SiO_2$) insulating film 21. The cathode conductive layer is further patterned into a series of parallel stripes 19 (referred to as "columns"), horizontally spaced at regular intervals by gaps or voids 17 formed in the cathode conductive layer material (FIGS. 2–6). An extraction or gate electrode 22 (FIG. 1) comprises a second electrically conductive layer deposited on an insulating dielectric layer 25 which serves to insulate and vertically space electrode 22 from the resistive and conductive layers 15, 18. Gate electrode 22 may be applied as a continuous sheet and is patterned into a series of parallel cross-stripes 24 (referred to as "rows"), horizontally spaced at regular intervals by gaps or voids 23 formed in the gate conductive layer material (FIGS. 2–4). Row cross-stripes 24 run transversely (and, preferably, perpendicular) to column stripes 19, defining imaging pixels 30 (FIG. 4) at intersections (viz. crossings) of the stripes 19 and cross-stripes 24. Each pixel 30 encompasses n×m subpixel mesh spacings 16. Microtips 14 are pointed cones formed within apertures 26 through conductive layer 22 and concentric cavities 28 of insulating layer 25 (FIG. 1).

Anode plate 11 (FIG. 1) comprises an electrically conductive layer of material 31 deposited on a transparent insulating glass substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a coating of phosphor cathodoluminescent material 34, deposited over the conductive layer 31, so as to be directly facing and immediately adjacent extraction electrode 22.

In accordance with conventional teachings, groupings of the microtip arrays 12 in mesh spacings 16 corresponding to a particular column-row image pixel location 30 can be energized by applying a negative potential to a selected column stripe 19 (FIG. 4) of cathode mesh structure 18 relative to a selected row cross-stripe 24 of extraction electrode 22, via a voltage source 35 (FIG. 1), thereby inducing an electric field which draws electrons from the associated subpixel arrays 12 of microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 31, completing the electrical circuit to voltage source 35. The various column-row intersections 30 of stripes 19 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11.

In accordance with the invention, to improve column-to-column electrical isolation, resistive layer 15 is patterned into a series of parallel stripes 40 (FIGS. 2–4 and 6) which are aligned and generally coincident with column stripes 19. Like stripes 19, stripes 40 are horizontally spaced at regular intervals by gaps or voids 42 formed in the resistive layer material, aligned and generally coincident with gaps 17 formed in the cathode conductive layer material. Gaps 42 are dimensioned and configured to remove a major portion of the resistive layer material from between adjacent column stripes 19. Unlike gaps 17 of cathode stripes 19, however, gaps 42 are bridged by narrow strips 43 of resistive material left unetched between adjacent resistive layer stripes 40. Strips 43 are configured to provide continuous paths of relatively uniform vertical thickness for support of the material of gate layer 22 at crossovers between columns 19 of the row cross-stripes 24. Strips 43 preferably run perpendicular to stripes 40, in general alignment with rows 24, and have the same thicknesses as neighboring portions of stripes 40. In general, at least one strip 43 is provided at each crossover of every row 24. The illustrated arrangement shows two identical strips 43 located at positions, respectively one-third and two-thirds the way along the horizontal width dimension (top-to-bottom direction in FIGS. 2–4) of the associated row 24. Each illustrated strip 43 has a horizontal width dimension of approximately 3–6% of the corresponding horizontal width dimension of the row 24.

FIGS. 7–10 illustrate a modified form 10' of the cathode structure 10, wherein the imaging region of gate electrode conductive material layer 22 is patterned into a gate mesh structure 45, offset from the cathode mesh structure 18, so that intersections of the connecting members of the gate mesh structure grid are located centrally within the cathode mesh spacings 16. Mesh structure 45 is enlarged at the intersections to provide pads 46 for location of apertures 26 of the microtip arrays 12. The remainder of the grid 45 comprises bridging strips 47 that interconnect neighboring pads 46. Cathode structure 10' has a resistive layer 15 (FIGS. 9–10) which is patterned into a series of parallel stripes 40 which are separated by gaps 42, just like those of structure 10. In contrast to resistive layer 15 of structure 10, however, resistive layer 15 of structure 10' is deposited before the patterned cathode conductive layer 18. Also, in contrast to the rows 24 of structure 10, corresponding rows 24 of structure 10' are further patterned to remove gate conductive layer material 22 from above the unbridged portions of the resistive layer gaps 42. Pads 46 of the same row 24 associated with the edges of a particular column 19 are commonly connected along marginal border regions 49 of resistive layer 15' along edges of gaps 42, by buses 50 defined by strips of conductive material 22 running in general longitudinal alignment (top-to-bottom direction in FIGS. 7 and 8) with the columns 19. For each row 24 of structure 10', the marginal buses 50 associated with one column 19 are connected to similar marginal buses 50 of adjacent columns 19, by crossover buses 52 defined by strips of conductive material 22 formed over the bridges 43 in general longitudinal alignment (left-to-right in FIGS. 7 and 8) with bridges 43. Within the limitations of the rows 24', buses 50, 52 are made generally coextensive, respectively, with the border regions 49 and bridges 43. The illustrated arrangement reduces the overall end amount of needed metalization in gate conductive layer 22, and avoids sharp transitions, thickness nonuniformities and discontinuities at crossovers of layer 22 at the gaps 42.

Those skilled in the art to which the invention relates will appreciate that the relative order of resistive layer 15 and cathode conductive layer 18 shown in the structures 10, 10' can be reversed. It will also be appreciated that continuous gate metalization at column-to-column transitions of rows 24 of structure 10 in FIGS. 2–6 can be used in combination with a mesh patterned gate, such as shown in FIGS. 7–10 for structure 10'. It will further be appreciated that crossover buses 52, such as shown for structure 10' in FIGS. 7–10, can be used together with structure 10 of FIGS. 2–6. Other substitutions and modifications to the described embodiments are also possible, without departing from the spirit and scope of the invention as defined by the claims below.

Formation of the structures 10, 10' can be done utilizing a self-alignment microtip emitter manufacturing process such as that described in U.S. Pat. Nos. 4,857,161, 5,194,780 and/or French Patent No. 2,687,839.

A cathode mesh structure 18, resistive layer 15, dielectric insulating layer 25 and gate electrode layer 22 are successively formed by known deposition processes on an upper surface of a glass or silicon substrate 20, which has been previously overlaid with a thin layer 21 of silicon dioxide ($SiO_2$) of about 500–1,000 Å thickness. The cathode electrode is, for example, formed by depositing a thin coating of conductive material, such as niobium of about 2,000 Å thickness, over the silicon dioxide layer 21 using cathodic sputtering. The mesh pattern 18 and patterns defining the columns 19 and gaps 17 are then produced in the cathode conductive layer by photolithography and etching, removing portions of the cathode conductive layer to define 25–30 micron generally square mesh spacings 16 and 40–60 micron gaps 17 at, e.g., 11×10 mesh spacings per 300 micron pixel 30. Resistive layer 15 may, for example, be formed as a resistive, doped or undoped silicon coating of 10,000–12,000 Å thickness, deposited by cathode sputtering or chemical vapor deposition over the patterned conductive layer 18 and mesh spacings 16. Resistive layer 15 is then patterned by photolithography and etching to define the stripes 40, gaps 42 and bridging strips 43. Spacer layer 25 is then formed as a silicon dioxide ($SiO_2$) layer of 1.0–1.2 micron thickness deposited by chemical vapor deposition over the patterned resistive coating 15. Alternatively, as illustrated with structure 10' in FIGS. 9–10, resistive layer 15 can be deposited and patterned before deposition of the conductive cathode structure layer 18. Spacer layer 25 is then deposited over the patterned mesh structure 18, with the patterned resistive coating 15 left exposed within the mesh spacings 16 and gaps 17.

Gate electrode layer 22 is formed by depositing a thin metal coating of niobium of, e.g., 4,000 Å thickness over the spacer layer 25. Next, gate layer 22 is masked and etched to define pluralities of, e.g., 4×4 apertures 26 of 1.0–1.4 micron diameters, at 3 micron aperture pitches and 25 micron aperture array pitches. The insulating layer 25 is also etched to form cavities 28 in alignment with apertures 26. Thereafter, while rotating the substrate 20, a sacrificial lift-off material layer of, e.g., nickel is deposited by low-angle electron beam deposition over layer 22. The beam is directed at an angle of 5°–20° to the surface (70°–85° from normal) so as to deposit lift-off layer material on the circumferential walls of apertures 26. Then, with substrate 20 again being rotated, molybdenum and/or other conductive tip forming material is deposited on the resistive layer 15 inside the cavities 28 by directing a beam substantially normal to the apertures 26 to form pluralities of arrays of, e.g., 4×4 arrays of microtips 14, self-aligned in respective concentric alignment within the corresponding 4×4 arrays of apertures 26 and cavities 28. The nickel lift-off layer is then removed, together with the superfluous molybdenum deposited over the nickel. Subsequent masking and etching is used to pattern the apertured layer 22, to define the row cross-stripes 24 and, if desired, the pads 46, bridging strips 47, and buses 50, 52.

The foregoing process is described for illustrative purposes only and not by way of limitation. In particular, it will be appreciated that the manner of completing particular deposition and removal steps, the order of such steps, and the described dimensions of the deposited and removed layers may be subject to variation in accordance with individual preferences and needs, without departing from the spirit and scope of the invention intended to be covered hereby.

What is claimed is:

1. An electron emitter comprising:

a substrate;

a first layer of conductive material deposited on said substrate; said first layer of conductive material being patterned in first stripes spaced by first gaps;

a layer of insulating material deposited on said substrate over said first layer of conductive material;

a second layer of conductive material deposited on said substrate over said layer of insulating material; said second layer of conductive material having a plurality of apertures located over each first stripe;

a layer of resistive material deposited on said substrate in electrical communication with said first layer of conductive material and insulated by said layer of insulating material from said second layer of conductive material; said layer of resistive material being patterned in second stripes generally aligned with said first stripes, said second stripes being spaced by second gaps leaving portions of said layer of resistive material bridging said second gaps; and a conductive microtip formed in each aperture in electrical communication with said layer of resistive material.

2. The electron emitter of claim 1, wherein said second gaps occupy a major portion of said resistive layer between said first stripes.

3. The electron emitter of claim 1, wherein said resistive layer is deposited in a layer of uniform thickness, and said second gaps are etched from said uniform layer leaving said bridging portions remaining.

4. The electron emitter of claim 1, wherein said second layer is patterned in cross-stripes running transverse to said first stripes, and wherein said second layer is further patterned to provide voids in said second layer overlying unbridged portions of said second gaps.

5. The electron emitter of claim 4, wherein said second layer is further patterned to provide bus connections defined by strips of second layer material formed over said resistive layer bridging portions, at cross-stripe transitions between adjacent second stripes.

6. The electron emitter of claim 1, wherein said first layer is patterned in a mesh structure defining a plurality of mesh spacings; and said second layer apertures are located within said mesh spacings.

7. The electron emitter of claim 1, wherein said second layer is patterned in a mesh structure having apertured pads; and said second layer is further patterned in cross-stripes running transverse to said first stripes; and wherein pads of the same cross-stripe and associated with a particular first layer stripe are commonly connected along second gap edges by buses defined by strips of second layer material formed over portions of said resistive layer material running marginally along edges of said second gaps.

8. The electron emitter of claim 7, wherein said first layer is patterned in a mesh structure defining a plurality of mesh spacings; said second layer apertured pads are located within said first layer mesh spacings; and said conductive microtips are laterally spaced by said resistive material from said first layer mesh structure.

9. The electron emitter of claim 7, wherein said second layer is further patterned to provide bus connections defined by strips of second layer material formed over said resistive layer bridging portions at cross-stripe transitions between adjacent second stripes; said bridging portion bus connections connecting adjacent ones of said marginally running buses.

10. The electron emitter of claim 1, wherein said second layer is patterned in cross-stripes running transverse to said first stripes, and wherein said bridging portions comprise strips of resistive layer material which are generally aligned with said cross-stripes.

11. The electron emitter of claim 1 disposed in an image display device further including another substrate spaced across a vacuum from said emitter, a layer of conductive material deposited on said another substrate facing said emitter, and cathodoluminescent material deposited over said another substrate in contact with said another substrate layer of conductive material.

12. An electron emitter, comprising:

a substrate;

a first layer of conductive material deposited on said substrate; said first layer of conductive material patterned in stripes, with gaps between adjacent stripes;

a layer of resistive material of a first vertical thickness deposited on said substrate; said layer of resistive material patterned with voids configured so that resistive layer material is absent from a major portion of said gaps;

a layer of insulating material of a second vertical thickness deposited on said substrate over said patterned first layer of conductive material and layer of resistive material;

at least one of said resistive material and insulating material layers shaped to continue the combined first and second vertical thicknesses of said resistive material and insulating material layers in continuous paths across said voids, bridging terrain discontinuities at said voids;

a second layer of conductive material deposited on said substrate over said layer of insulating material and said continuous paths; said second layer of conductive material formed with a plurality of apertures over said stripes; said apertures extending through said insulating layer; and a conductive microtip formed in each aperture in electrical communication with said resistive layer.

13. The electron emitter of claim 12, wherein said resistive layer is patterned in second stripes generally aligned with said first stripes and spaced by second gaps.

14. The electron emitter of claim 13, wherein said resistive layer is patterned in said second stripes, with strips of said layer of resistive material bridging said second gaps.

15. An electron emitter, comprising:

a substrate;

a first layer of conductive material deposited on said substrate; said first layer of conductive material patterned in first stripes spaced by first gaps;

a layer of resistive material deposited on said substrate in electrical communication with said first layer of conductive material; said layer of resistive material patterned in second stripes generally aligned with said first stripes, said second stripes spaced by second gaps leaving second gaps, leaving portions of said resistive layer material bridging said second gaps;

a layer of insulating material deposited on said substrate over said first layer of conductive material and layer of resistive material;

a second layer of conductive material deposited on said substrate over said layer of insulating material;

a plurality of apertures formed in said second layer over said stripes; said apertures extending through said insulating layer; and a conductive microtip formed in each aperture in electrical communication with said layer of resistive material.

16. The electron emitter of claim 15, further comprising said second layer patterned in cross-stripes running transverse to said first stripes, and said second layer further patterned to provide voids in said second layer overlying unbridged portions of said second gaps.

17. The electron emitter of claim 16, further comprising said second layer patterned to provide bus connections defined by strips of second layer material formed over said resistive layer bridging portions, at cross-stripe transitions between adjacent second stripes.

18. The electron emitter of claim 15, wherein said first layer is further patterned in a mesh structure defining a plurality of mesh spacings; and said second layer apertures are formed within said mesh spacings.

19. The electron emitter of claim 15, further comprising said second layer patterned in a mesh structure having apertured pads; said second layer further patterned in cross-stripes running transverse to said first stripes; and strips of second layer material formed over portions of said resistive layer material running marginally along edges of said second gaps defining buses commonly connecting pads of the same cross-stripe and associated with a particular first layer stripe.

20. The electron emitter of claim 19, wherein said first layer is further patterned in a mesh structure defining a plurality of mesh spacings; said second layer apertured pads are formed within said first layer mesh spacings; and said conductive microtips are laterally spaced by said resistive material from said first layer mesh structure.

21. The electron emitter of claim 19, wherein said second layer is further patterned to provide bus connections defined by strips of second layer material formed over said resistive layer bridging portions at cross-stripe transitions between adjacent second stripes; said bridging portion bus connections connecting adjacent ones of said marginally running buses.

22. The electron emitter of claim 15, wherein said second layer is patterned in cross-stripes running transverse to said first stripes, and wherein said bridging portions comprise strips of resistive layer material which are generally aligned with said cross-stripes.

23. The electron emitter of claim 15, in an image display device, further comprising another substrate spaced across a vacuum from said emitter; a layer of conductive material on said another substrate facing said emitter; and cathodoluminescent material over said another substrate in contact with said another substrate layer of conductive material.

* * * * *